US005353975A

United States Patent [19]

Libertucci

[11] Patent Number: 5,353,975

[45] Date of Patent: Oct. 11, 1994

[54] CARRIER FOR A PORTABLE STEREO UNIT

[76] Inventor: Michael Libertucci, P.O. Box 549, Amsterdam, N.Y. 12010

[21] Appl. No.: 43,366

[22] Filed: Apr. 6, 1993

[51] Int. Cl.[5] ..... A45F 3/00

[52] U.S. Cl. ..... 224/224; 224/910

[58] Field of Search ..... 224/195, 202, 222, 224, 224/227, 229, 236, 237, 240, 910, 242, 904

[56] References Cited

U.S. PATENT DOCUMENTS

| | | | |
|---|---|---|---|
| 4,029,243 | 6/1977 | Zerobnick et al. | 224/224 |
| 4,432,477 | 2/1984 | Haidt et al. | 224/222 |
| 4,450,495 | 5/1984 | Naruki . | |
| 4,479,596 | 10/1984 | Swanson | 224/240 X |
| 4,569,465 | 2/1986 | O'Farrell . | |
| 4,620,653 | 11/1986 | Farrell . | |
| 4,722,464 | 2/1988 | Wright . | |
| 4,798,539 | 1/1989 | Henry et al. . | |
| 4,834,274 | 5/1989 | Johnson | 224/240 |
| 4,858,798 | 8/1989 | Siddoway et al. | 224/242 |
| 5,209,385 | 5/1993 | Ledesma | 224/224 |
| 5,240,156 | 8/1993 | Sicotte et al. | 224/224 X |

*Primary Examiner*—Glenn J. Barrett

*Attorney, Agent, or Firm*—Schmeiser, Morelle & Watts

[57] ABSTRACT

The invention is a multi-compartmented belt-type carrier for a portable stereo unit having separate speakers. Each compartment is designed to receive a speaker and has a front face that includes at least one foraminous area that functions to allow a virtually non-obstructed transmission of sound from a housed speaker to the ambient environment. The carrier includes a movable cover member that is adapted to overlie the compartments. In addition, a flexible base is used to support the compartments, thereby allowing relative movement between the compartments and enhancing the fit of the device to the wearer.

9 Claims, 2 Drawing Sheets

CARRIER FOR A PORTABLE STEREO UNIT

FIELD OF THE INVENTION

The invention is in the field of article carriers. More particularly, the invention is a belt-type carrier that has three separate, articulated compartments. The carrier is designed to inwardly contain a stereo unit and a pair of individual speakers.

BACKGROUND OF THE INVENTION

In recent years, personal/portable stereo units (such as the WALKMAN unit sold by the SONY Corp.) have become popular and are used by large numbers of people during their leisure time. These units typically include a miniature radio receiver and/or cassette or compact disc player that has a belt hook for securement to the belt of a wearer. In addition, these units employ a pair of lightweight earphones that are connected to the receiver/player by thin wires.

These portable units may be used indoors or out and are often worn by individuals who are walking or exercising in other ways. The units provide high fidelity sound at a relatively low cost. However, there are three problems that are commonly experienced by a wearer of a portable stereo unit of this type.

The first problem is that many people find it uncomfortable or unpleasant to wear earphones. When wearing earphones, sound is heard not from a distance but seemingly from within the user's head. While this affords clearly defined sound reproduction, this effect can be disconcerting, and for many people, unpleasant. Music heard in this manner is noticeably different from what would be heard at a concert or produced by a typical home stereo that has external speakers. To overcome this problem, it is possible to buy a pair of compact, separate speakers that can be wired to the receiver/player in a manner similar to a home stereo unit. However, these speakers are designed for stationary applications such as placement on a desk or table, and therefore defeat the portability of the original unit.

A second problem with prior art portable stereo units is that when one is wearing earphones, it becomes extremely difficult to hear outside sounds. For someone walking or jogging, this can prevent one from hearing the approach of a car or a shouted warning. The use of earphones also prevents a wearer from conversing with anyone nearby.

A third problem is that when the receiver/player of a portable stereo unit is hung from the user's belt, the unit's weight is unevenly distributed on the user's body. This can be uncomfortable or awkward and is most noticeable when a user is walking or running.

BRIEF SUMMARY OF THE INVENTION

The invention is a belt-type carrier adapted to removably house a portable stereo unit of the type having a central radio receiver and/or cassette or CD player (receiver/player unit) and a pair of external, separable speakers. The stereo's central unit and speakers are secured within an elongated pouch structure that has three separate, linearly-aligned compartments.

The pouch's center compartment is adapted to securely house the stereo's receiver/player unit. The pouch's two outer compartments are located on opposite sides of the center compartment and are each designed to house one of the stereo unit's separate speakers. The pouch's outer compartments are attached to the carrier in a manner that allows them to move relative to the pouch's center compartment to thereby facilitate the carrier's ability to conform to the shape of the wearer's body.

The pouch includes a top-located flap that is adapted to overlie the three interior compartments. A releasable fastening system such as complementary hook and pile structures are used to releasably secure the flap to the front face of the pouch. The flap is substantially waterproof to prevent rain from entering the interior of the pouch.

Each of the pouch compartments that are designed to house the stereo unit's speakers features a unique front covering. The covering allows the sound emitted by the speaker to leave the pouch without being muffled by the pouch material. This is accomplished through the use of spaced bands of open mesh material located in the fabric. These bands of open mesh have a large percentage of open area through which sound may pass without interference. In this manner, the contained speakers can easily provide an ample volume of sound for the user. The term "material construction " generically means a particular material configuration resulting from the manner in which the material is put together (e.g. woven), devised, or formed.

The carrier allows hands-free portability of a stereo unit with separate speakers. By using the carrier as described, a user can enjoy listening to music and still have the ability to hear other exterior sounds.

DETAILED DESCRIPTION OF THE DRAWINGS

Figure 1:
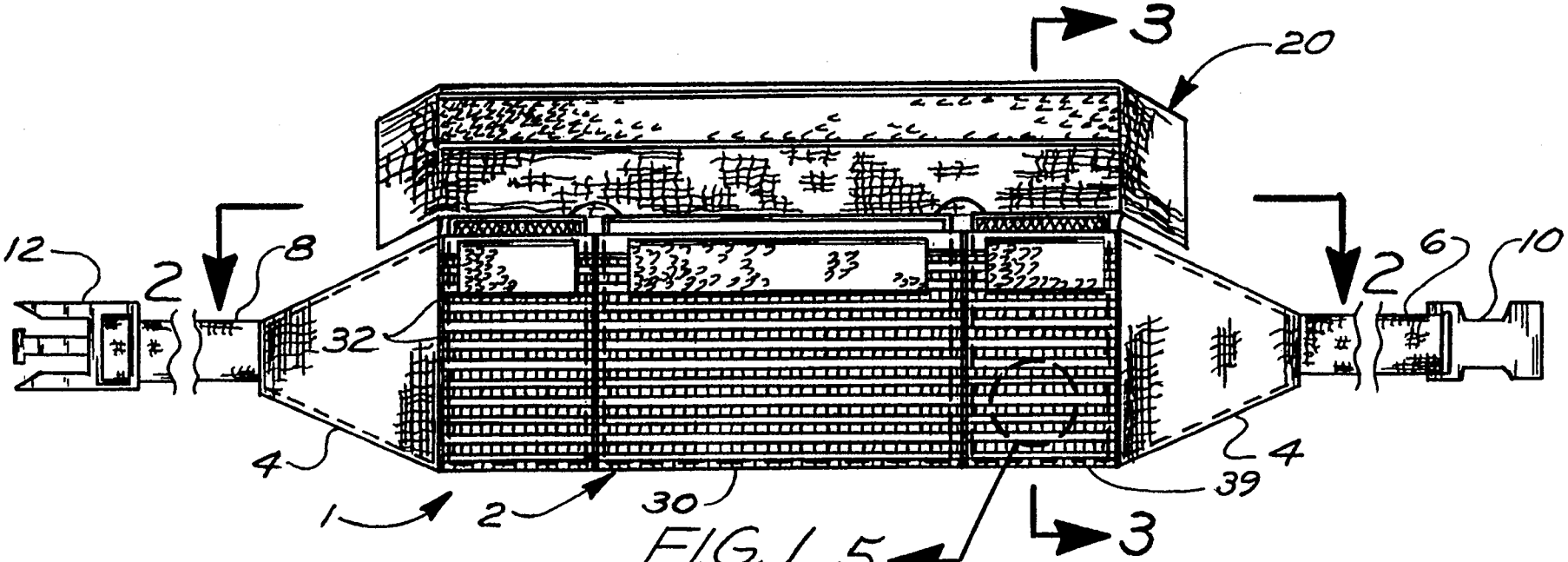
FIG. 1 is a front view of a portable stereo carrier in accordance with the invention.
Figure 2:
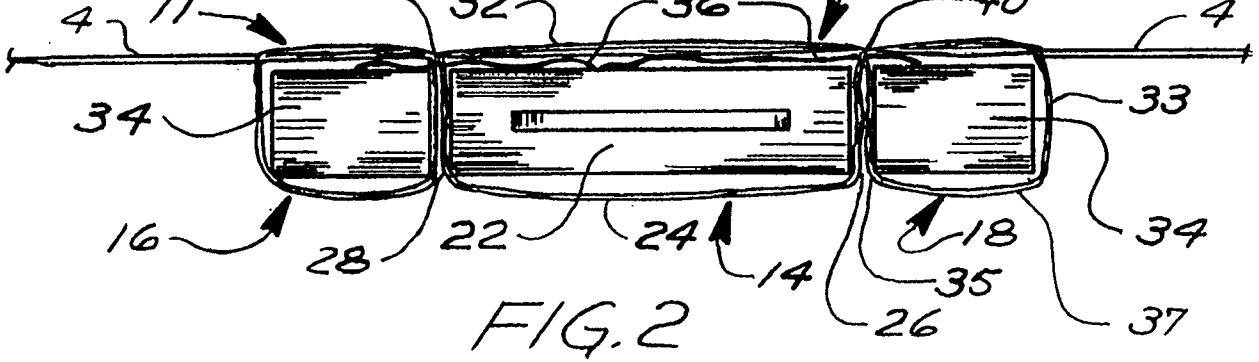
FIG. 2 is a top view of the carrier shown in FIG. 1 taken at a point just above the pouch compartments.

Referring now to the drawings in greater detail, wherein like reference characters refer to like parts throughout the several figures, there is shown by the numeral 1 a portable stereo unit carrier in accordance with the invention.

The carrier is in the form of a belt-type unit that is similar in appearance to the type of carrier commonly referred to as a "fanny pack." The unit includes a multi-compartmented pouch structure 2 that has trapezoidally-shaped support members 4 at each end. A strap/belt portion 6 is connected to the outer end of the right-hand support member 4 and a second strap/belt portion 8 is connected to the outer end of the left-hand support member. Strap 6 has a receiver member 10 at its distal end that is designed to releasably receive a complementary pronged member 12 that is located at the distal end of strap 8. A wearer secures the carrier in place by interlocking members 10 and 12 after the carrier is placed about the wearer's waist.

The pouch 2 is predominantly made from a flexible fabric material such as nylon. The front material of the pouch is stitched to the pouch's rear wall/securement surface 11 in a manner that creates three separate interior housings or compartments; a central compartment 14 and two side compartments 16 and 18. A movable cover/flap 20 is located at the top of the pouch and is used to overlie the open top of each of the three compartments.

The central compartment 14 is rectangular in shape and is sized to snugly receive a receiver/player portion of a portable stereo unit. A generalized receiver/player unit 22 is shown within the compartment. The compartment has a front face 24, two sides 26 and 28 and a bottom surface 30. The compartment's rear wall 32 is the terminus for the sidewalls and is formed from the rear wall 11 of the pouch. Preferably, the central compartment is approximately six inches in length by approximately four inches in height. Due to the nature of the fabric material that forms the front and sides of the compartment (as will be described later), the width of the pouch compartment is variable. However, the central compartment is designed to fit a receiver/player unit that has a thickness of approximately one to three inches.

The two side compartments 16 and 18 are designed to house a pair of speakers 34 that are operatively connected to the receiver/player unit by wires 36. The speakers are of a compact type that are normally sold for use with a portable stereo unit when the unit is to remain stationary with the speakers placed on a flat surface. In the preferred embodiment, each side compartment has sides 33 and 35, a front face 37 and either a triangular or rectangular bottom surface 39. It has been found that a somewhat triangular shape for each of compartments 16 and 18 allows the compartment to snugly house either a square, rectangular or triangular speaker.

It should be noted that the front and sides of each of the three compartment are preferably formed using a single sheet of flexible material that is stitched to the rear wall 11 of the pouch at each side edge 40 of a compartment. In this manner, the rear wall 11 forms a support means for all three compartments. In addition, the flexible rear wall 11 of the pouch is connected to straps 6 and 8 via the trapezoidally-shaped members 4 located at each of its ends. In this manner, the wall 11 basically forms the center portion of a flexible belt in which straps 6 and 8 form its ends. Since the compartments are connected to the wall 11 only at their edges, the outer compartments 16 and 18 can bend with rear wall 11 relative to the center compartment 14 to thereby conform to the shape of a user's waist.

Figures 3, 4, 5:
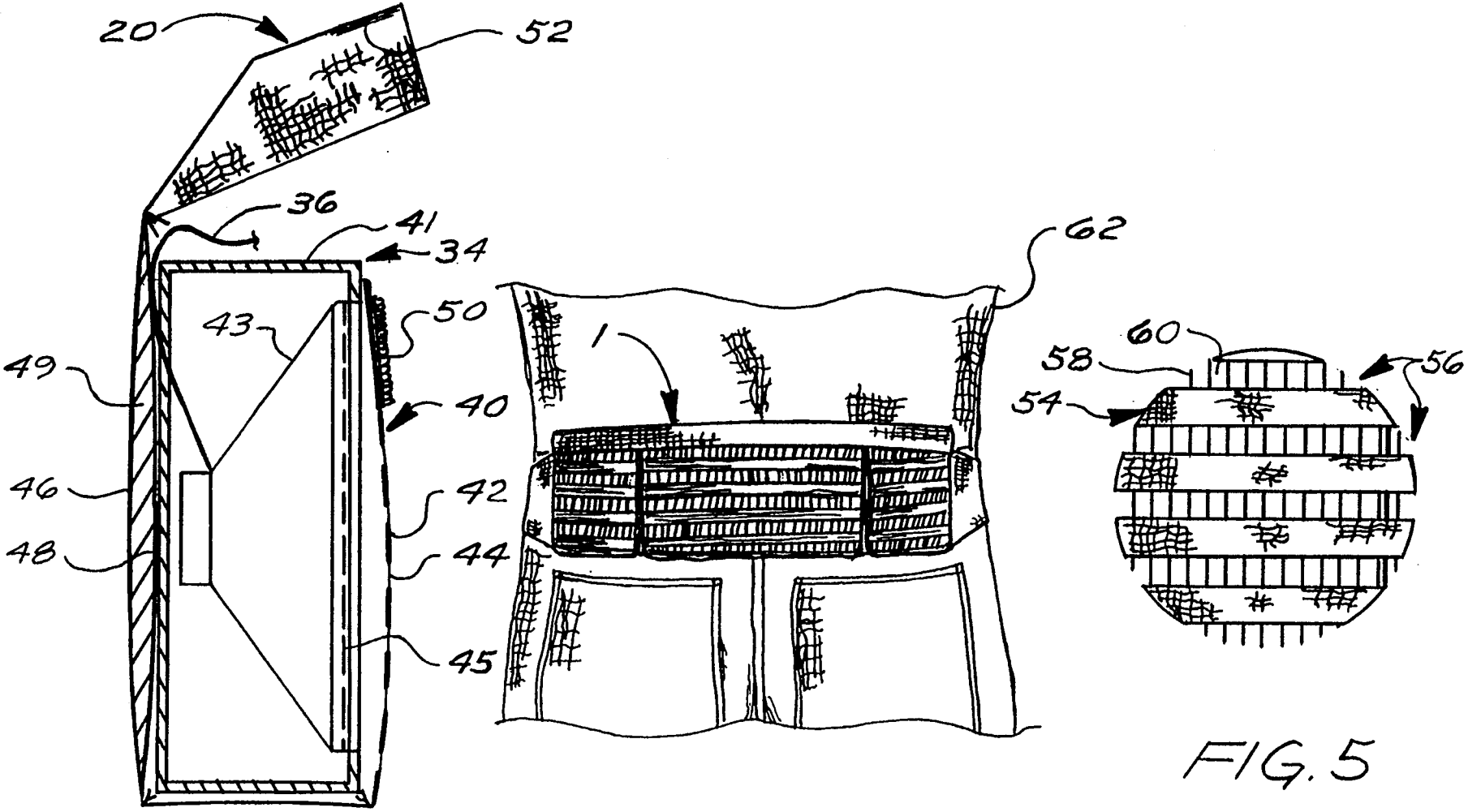
FIG. 3 is a cross-sectional view of the carrier shown in FIG. 1 taken along the plane indicated at 3—3.
FIG. 4 is a view of the carrier of FIG. 1 being worn by a user.
FIG. 5 is a detailed view of a portion of the front face of the carrier shown in FIG. 1.

FIG. 3 provides a cross-sectional view of the pouch taken along a plane through the side compartment 18. In this view, the speaker 34 can be clearly seen as well as the structure of the surrounding material.

The speaker includes an outer housing 41 that surrounds a speaker cone 43. A wire 36 extends from the speaker to the stereo unit's receiver/player unit 22. Located at the front of the speaker is a grill 45 that is designed to protect the speaker while not interfering with the emitted sound.

The rear wall 11 of the pouch includes an outer fabric wall 46 and an inner fabric wall 48. A layer of cushioning material 49 is sandwiched between the two walls. This sandwich structure is found behind all three of the pouch compartments.

The flap 20 is preferably made from a nylon material. It is designed to overlie the pouch compartments and is secured to the top of the pouch's rear wall 11. The front of the pouch includes one portion 50 of a hook and pile fastener system with the complementary portion 52 located on an interior surface of the flap. When secured in place, the flap completely overlies each of the compartments and thereby prevents rain from entering the compartments from the top and also helps to prevent rain from contacting the front and sides of each compartment. It should be noted that as an alternate embodiment, each compartment can be provided with its own separate flap.

The bottom of each pouch compartment is fabricated from one or more fabric sheets and is designed with a very tight weave that is nearly impermeable to water. In the preferred embodiment, a nylon taffeta material is employed.

As noted previously, the front and sides of each of the three compartments is formed from a single sheet of a specially-designed sound-transmissible fabric material that is also designed to be stretchable. A portion of the material is detailed in FIG. 5.

As can be seen in FIG. 5, the fabric has two types of horizontally-oriented bands that are arranged in an alternating pattern. The first type of band 54 is an elastic, tightly woven material that is designed to be expandable in a horizontal direction. The second type of band 56 is foraminous and is in the form of an extremely loose open mesh that is composed of vertical partitions 58 that define the sides of a plurality of visually-discernable open areas 60. In the preferred embodiment, each band 56 of open mesh has a height of approximately one-tenth of an inch and has approximately thirty to fifty narrow partitions per inch of length when in an un-stretched state. In this manner, each band of open mesh contains approximately twenty to ninety percent open area.

The partitions 58 are in the form of thin, wirelike pieces of plastic that are preferably non-absorbent to sound. The partitions are anchored at their ends to adjacent bands 54 of the extensible material. In this manner, each foramen or open area 60 between partitions 58 increases in length and therefore area when the fabric forming the front and sides of the compartment is stretched to receive either the associated speaker or receiver/player unit. When a speaker is within either of compartments 16 or 18, it is preferably oriented so that the speaker grill 45 is against the front face of the compartment. In this manner, any sound emitted by the speaker can pass without significant interference or muffling through the open areas 60 located in the bands 56 of open mesh.

In FIG. 4, the device is shown being worn by a user 62. The portable stereo unit is completely housed within the pouch of the carrier and is located about the user's waist. In this manner, the speakers can provide music that is clearly audible by the wearer. It should be noted that the carrier can be placed on a wearer so that its pouch portion 2 is located either at the front or back of the wearer. The trapezoidal shape of support members 4 helps to prevent pivoting of the pouch in either location. It should also be noted that the carrier can be secured to a wall or other support and used as a stationary support for the stereo unit.

The embodiment disclosed herein has been discussed for the purpose of familiarizing the reader with the novel aspects of the invention. Although a preferred embodiment of the invention has been shown and described, many changes, modifications and substitutions may be made by one having ordinary skill in the art without necessarily departing from the spirit and scope of the invention as described in the following claims.

I claim:

1. A carrier for a portable stereo, said carrier comprising:

a belt;

belt fastening members for releasably securing ends of said belt;

support members, secured to said belt; and a plurality of stereo receiving compartments positioned between said support members, said compartments including:

a first compartment of a size adapted for receiving a receiver/player unit of a portable stereo, wherein said first compartment includes at least one cover member adapted to removably cover a top opening of said first compartment; and a second compartment of a size adapted for receiving a speaker, said second compartment having a rear wall and a front face, at least a portion of said rear wall made of a first material construction and at least a portion of said front face made of a second material construction, wherein said second material construction includes a foraminous region which allows sound to pass more freely therethrough than through said first material construction.

2. The carrier of claim 1, wherein the second material construction is an open mesh configuration.

3. The carrier of claim 2, wherein the open mesh configuration is formed using flexible material.

4. The carrier of claim 1, wherein the support members are trapezoidally-shaped.

5. The carrier of claim 1, wherein said cover member is attached by a hook and pile fastener system.

6. A carrier for a portable stereo, said carrier comprising:

a belt;

belt fastening members for releasably securing ends of said belt;

support members, secured to said belt; and a plurality of stereo receiving compartments positioned between said support members, said compartments including:

a first compartment of a size adapted for receiving a receiver/player unit of a portable stereo; and a second compartment of a size adapted for receiving a speaker, said second compartment having a rear wall and a front face, at least a portion of said rear wall made of a waterproof nylon and at least a portion of said front face made of a second material construction, wherein said second material construction includes a foraminous region which allows sound to pass more freely therethrough than through said first material construction.

7. A method for using a portable stereo system comprising:

providing a carrier for a portable stereo, said carrier comprising:

a belt strap;

belt fastening members for releasably securing said belt strap;

trapezoidally-shaped support members, secured to said belt strap; and a plurality of stereo receiving compartments attached to said trapezoidally-shaped support members, said compartments including:

a first compartment of a size adapted for receiving a receiver/player unit of a portable stereo; and a second compartment of a sized adapted for receiving a speaker, wherein said second compartment includes a foraminous region;

placing a receiver/player unit into the first compartment; placing a speaker into the second compartment; and allowing sound from said speaker to pass outwardly through the foraminous region.

8. The method for using a portable stereo system of claim 7, further comprising:

providing said second compartment with a rear wall and a front face, at least a portion of said rear wall made of a first material construction and at least a portion of said front face made of a second material construction, said second material construction allowing sound to pass more freely therethrough than through said first material construction, wherein said foraminous region is on said front face and is made from said second material construction.

9. The method for using a portable stereo system of claim 8, wherein the first compartment includes a front face, sides, and a rear wall which define an opening in a top thereof, said front wall including a first portion of a hook and pile fastener system; a flap, having a top side and a bottom side, attached to at least a portion of said rear wall, said flap including a complementary portion of said hook and pile fastener system, the method steps further comprising:

closing the flap by fastening together said hook and pile fastener system.

* * * * *